US007451563B1

(12) United States Patent
McKnight

(10) Patent No.: US 7,451,563 B1
(45) Date of Patent: Nov. 18, 2008

(54) 8-IN-1 DELUXE FIELD LOADER

(76) Inventor: Larry Donald McKnight, 4885 St. Louis Rock Rd., Villa Ridge, MO (US) 63089

( * ) Notice: Subject to any disclaimer, the term of this patent is extended or adjusted under 35 U.S.C. 154(b) by 131 days.

(21) Appl. No.: 11/388,257

(22) Filed: Mar. 24, 2006

(51) Int. Cl.
*F41C 9/08* (2006.01)

(52) U.S. Cl. ..... 42/51; 42/106

(58) Field of Classification Search ..... 42/51, 42/90, 106; 89/1.3
See application file for complete search history.

(56) References Cited

U.S. PATENT DOCUMENTS

| | | | | |
|---|---|---|---|---|
| 4,442,620 | A * | 4/1984 | Drake et al. | 42/90 |
| 4,466,209 | A * | 8/1984 | Strickland et al. | 42/90 |
| 4,550,517 | A * | 11/1985 | Mansfield | 42/90 |
| 4,601,125 | A * | 7/1986 | Curtis | 42/90 |
| 4,607,446 | A * | 8/1986 | Scheuring | 42/90 |
| 4,974,357 | A * | 12/1990 | Jones et al. | 42/90 |
| 5,081,781 | A * | 1/1992 | Kanyuck et al. | 42/90 |
| 5,097,615 | A * | 3/1992 | Kearns | 42/90 |
| 5,109,623 | A * | 5/1992 | French | 42/90 |
| 5,182,412 | A * | 1/1993 | Mazza | 42/90 |
| 6,672,476 | B2 * | 1/2004 | Cash et al. | 221/311 |
| 6,865,840 | B2 * | 3/2005 | Kanyuck et al. | 42/90 |
| 6,918,201 | B1 * | 7/2005 | Guillory | 42/51 |
| 7,165,351 | B2 * | 1/2007 | Church | 42/51 |
| 7,249,433 | B2 * | 7/2007 | Wilson | 42/51 |
| 2006/0086029 | A1 * | 4/2006 | Kirkpatrick | 42/51 |
| 2006/0162218 | A1 * | 7/2006 | Church | 42/51 |
| 2006/0162219 | A1 * | 7/2006 | Wilson | 42/51 |

* cited by examiner

*Primary Examiner*—Bret Hayes

(57) ABSTRACT

A molded plastic device which contains all the components that are necessary to perform the multiple steps required in loading a percussion in-line muzzle loading rifle in the field. Incorporated in this device are provisions for carrying multiple powder charges along with a bullet/projectile for each. The device also contains several different means of igniting said powder charges. By the use of different magazines, each of which contain a different form of ignition, the device can be used with several types and styles of muzzle loading rifles which may require different methods of discharging the bullet/projectile. The device also contains a bullet/projectile starter which is used to start the bullet/projectile down the barrel a few inches prior to seating the bullet/projectile with a ram rod. The device is carried on a neck strap which makes it easily accessible when loading in the field.

12 Claims, 9 Drawing Sheets

8-IN-1 DELUXE FIELD LOADER

BACKGROUND

The reason for my invention is to provide all the necessary components for loading an in-line percussion muzzle loading rifle in the field in one compact unit. This device can be used to load and fire several types and styles of modern in-line percussion muzzle loading rifles which may require different forms of ignition. By the use of this invention, a hunter/shooter can load and fire a fast second shot if needed without handling individual devices such as powder charge, projectile/bullet, bullet starter, and a device which dispenses either a number eleven percussion cap, individual 209 shotgun primer, or a water-proof plastic jacket that contains a 209 shotgun primer. This invention is constructed to handle three types of ignition systems, several different calibers of bullets/projectiles, and light or heavy powder charges. To accommodate different calibers of bullets, all the shooter has to do is insert a reducing tube into the loading tube. This tube will reduce the loading tube to the desired caliber as well as let the shooter use the proper caliber of powder pellets. By using the magazine contained in the main body or by inserting one of the other two magazines provided with the device, the three basic types of ignitions for percussion in-line muzzle loading rifles can be accommodated.

SUMMARY

Since the 8-in-one Deluxe Field Loader has all the needed components for loading an in-line percussion muzzle loading rifle in the field and is light and can be carried around the neck, it gives the hunter easy access when needed. Also lets the hunter use the loader for different calibers and types of rifles they may own or shoot without buying separate units to perform the different operations needed to reload in the field. The device is very convenient for reloading on the ground, tree stand, or in any type of shooting blind. The 8-in-one Deluxe Field Loader is very quiet (which is very important) when used and carried in the field. All the ignition types in the device are spring loaded and won't rattle even when the magazines are empty. The device is easy to refill while in the field and provides the hunter with a quick second shot if needed.

DESCRIPTION

Figure 1:
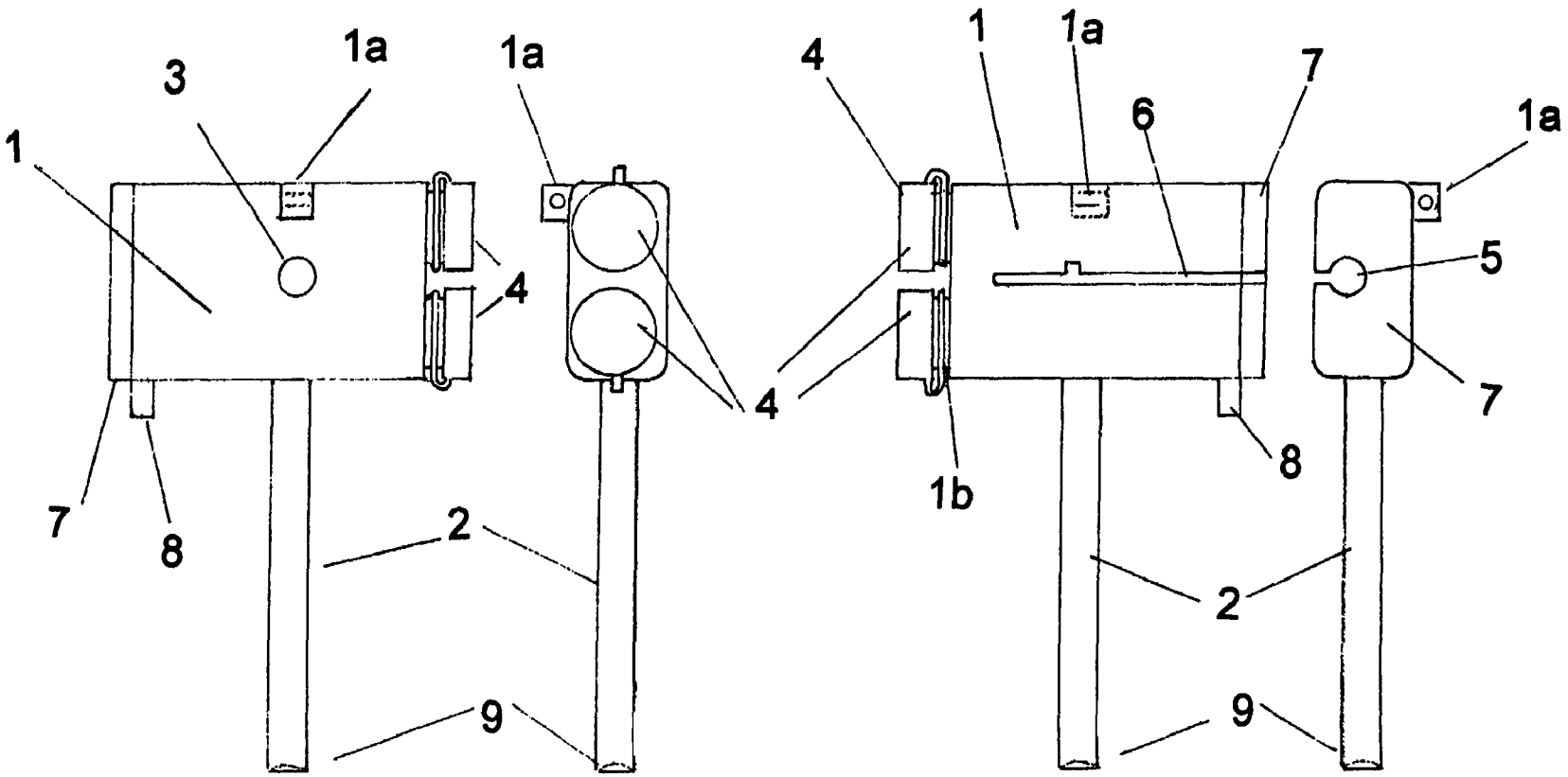
Figure 2:
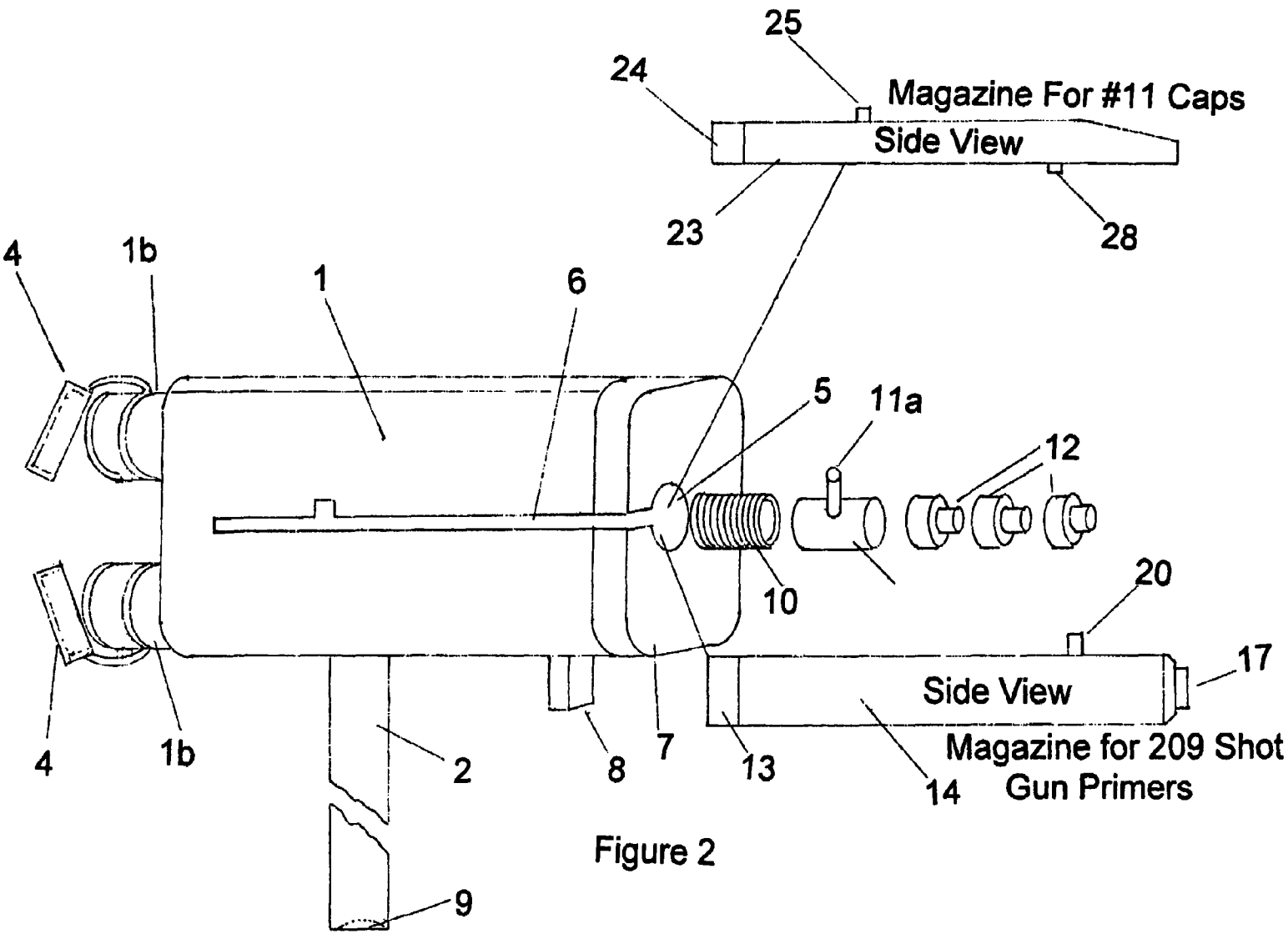
Figure 3:
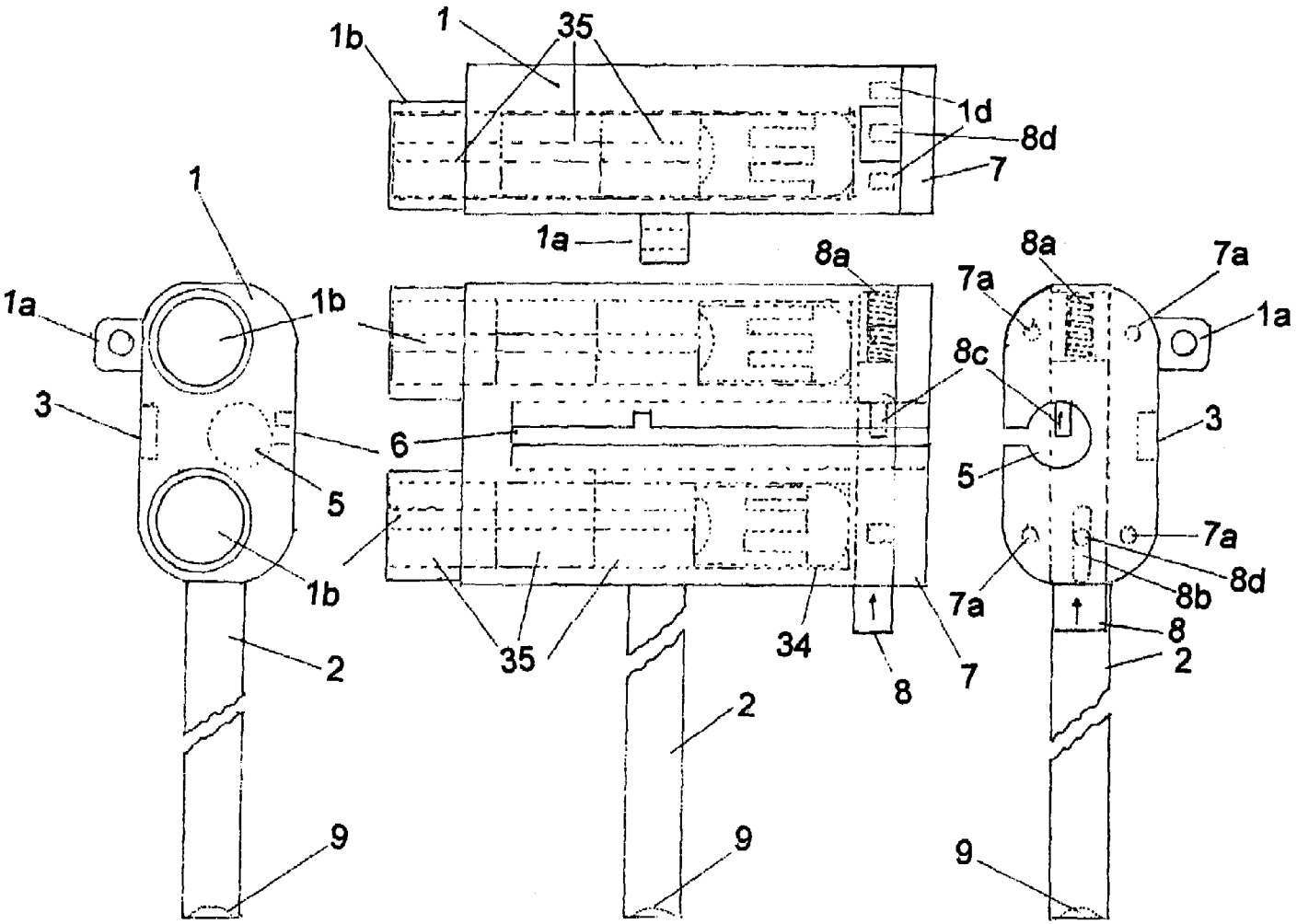
Figure 4:
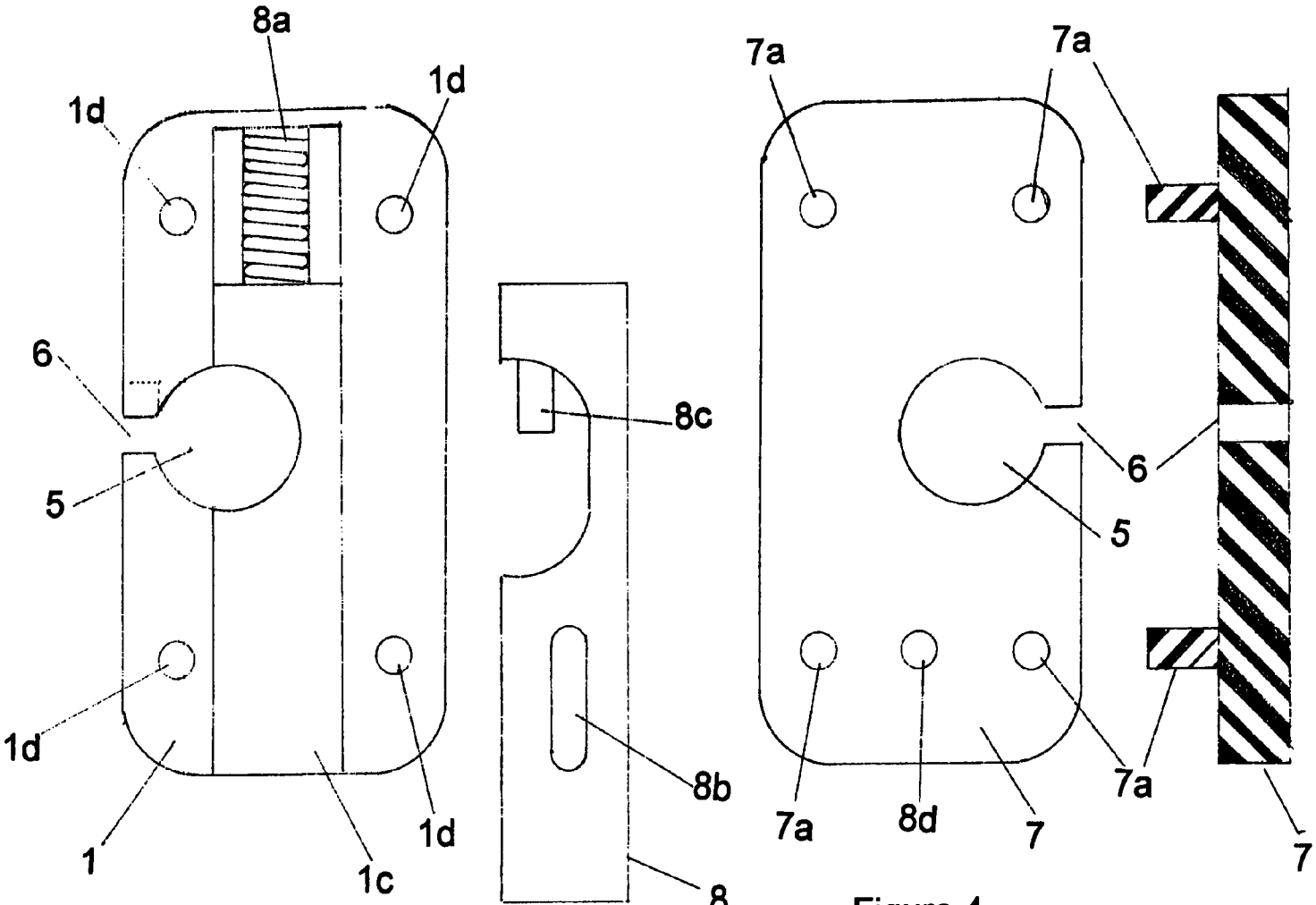
Figure 5:
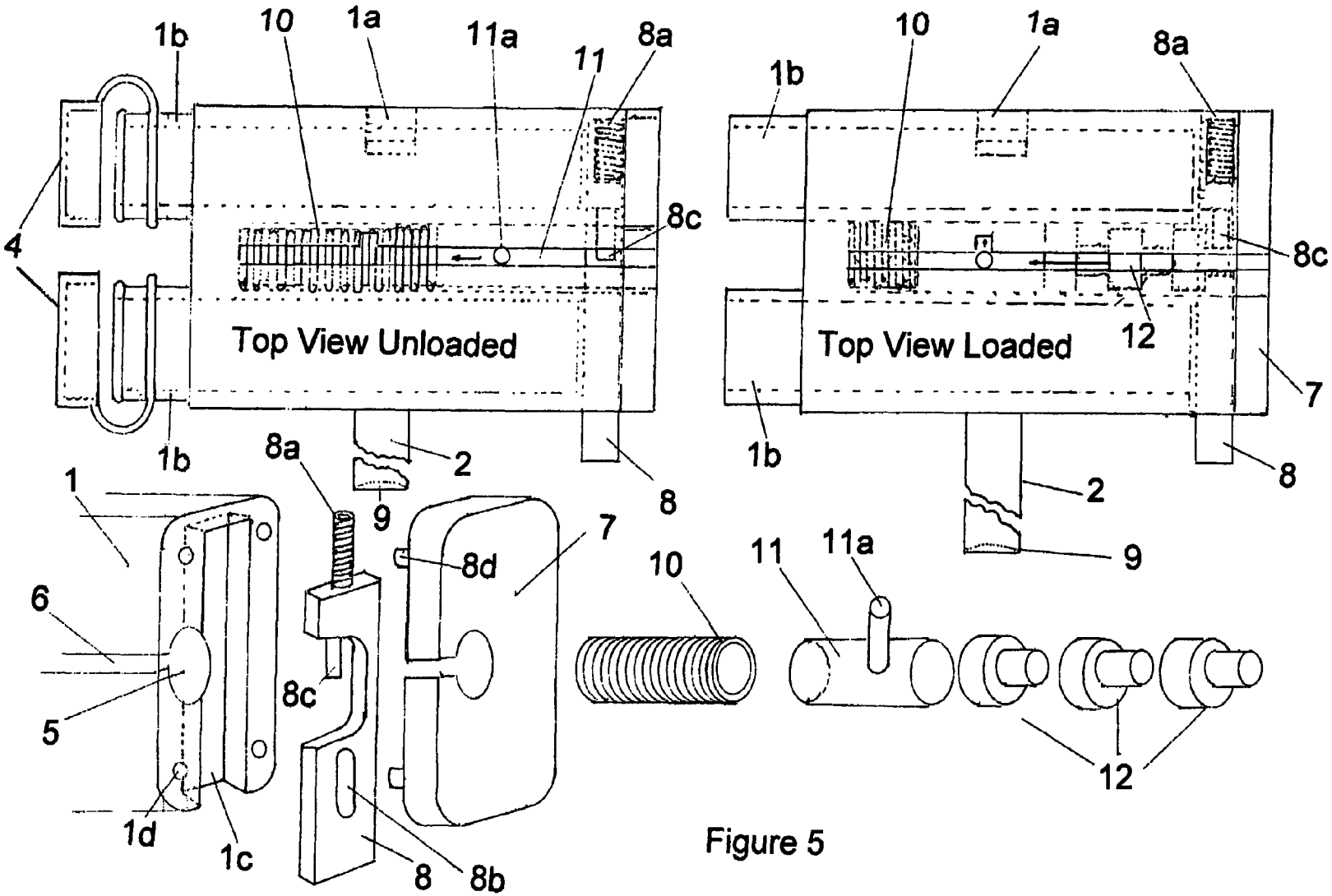
Figure 6:
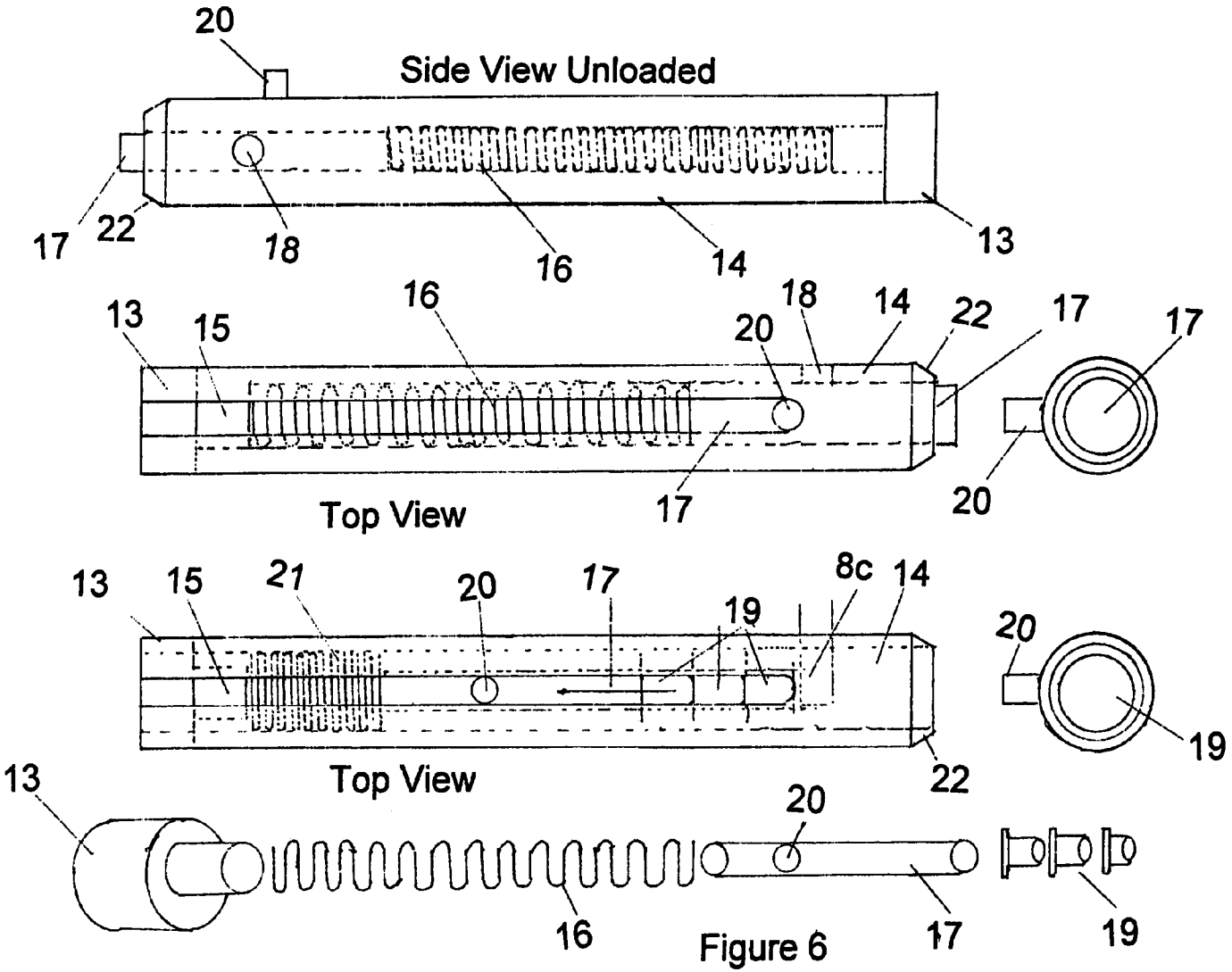
Figure 7:
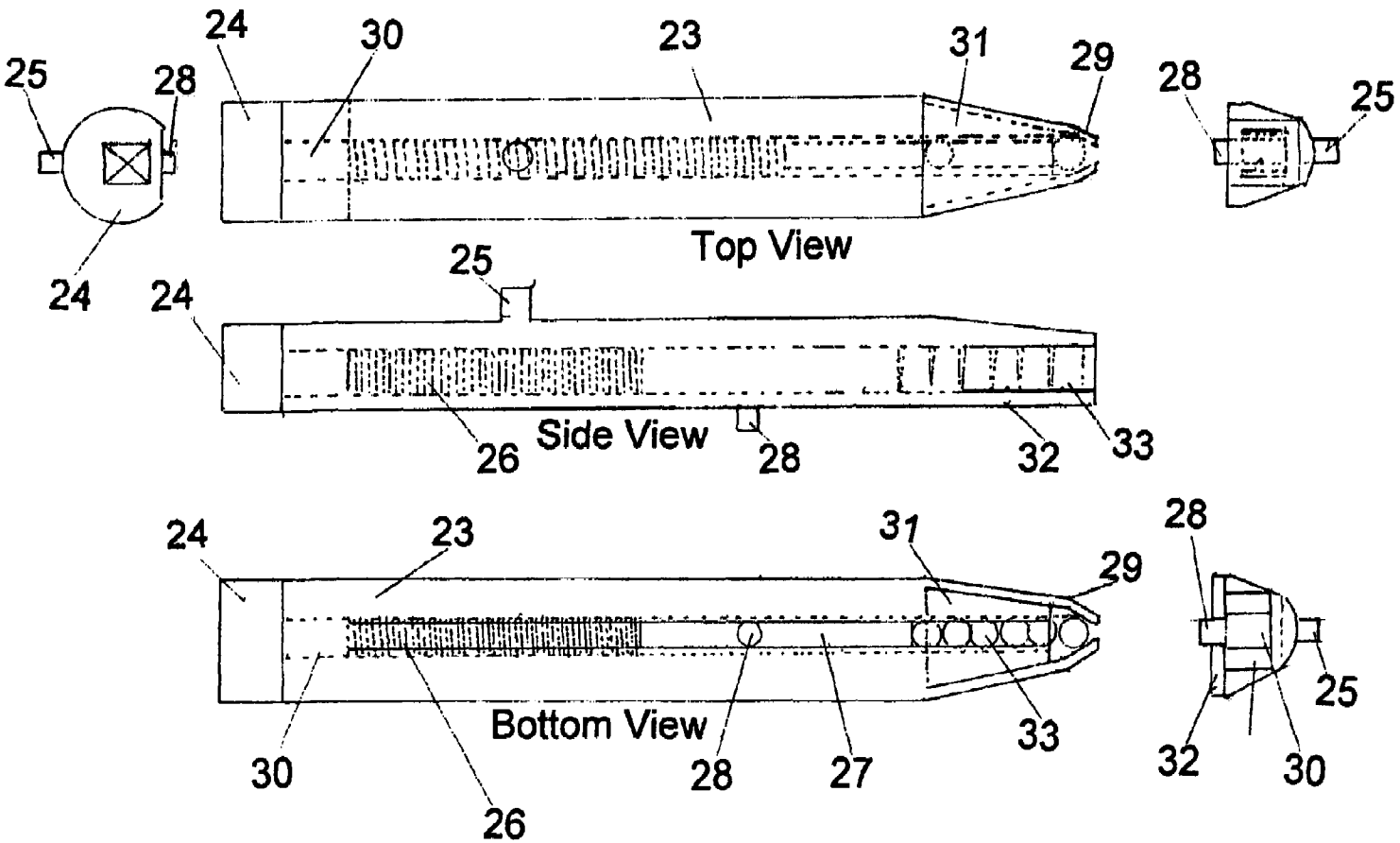
Figure 8:
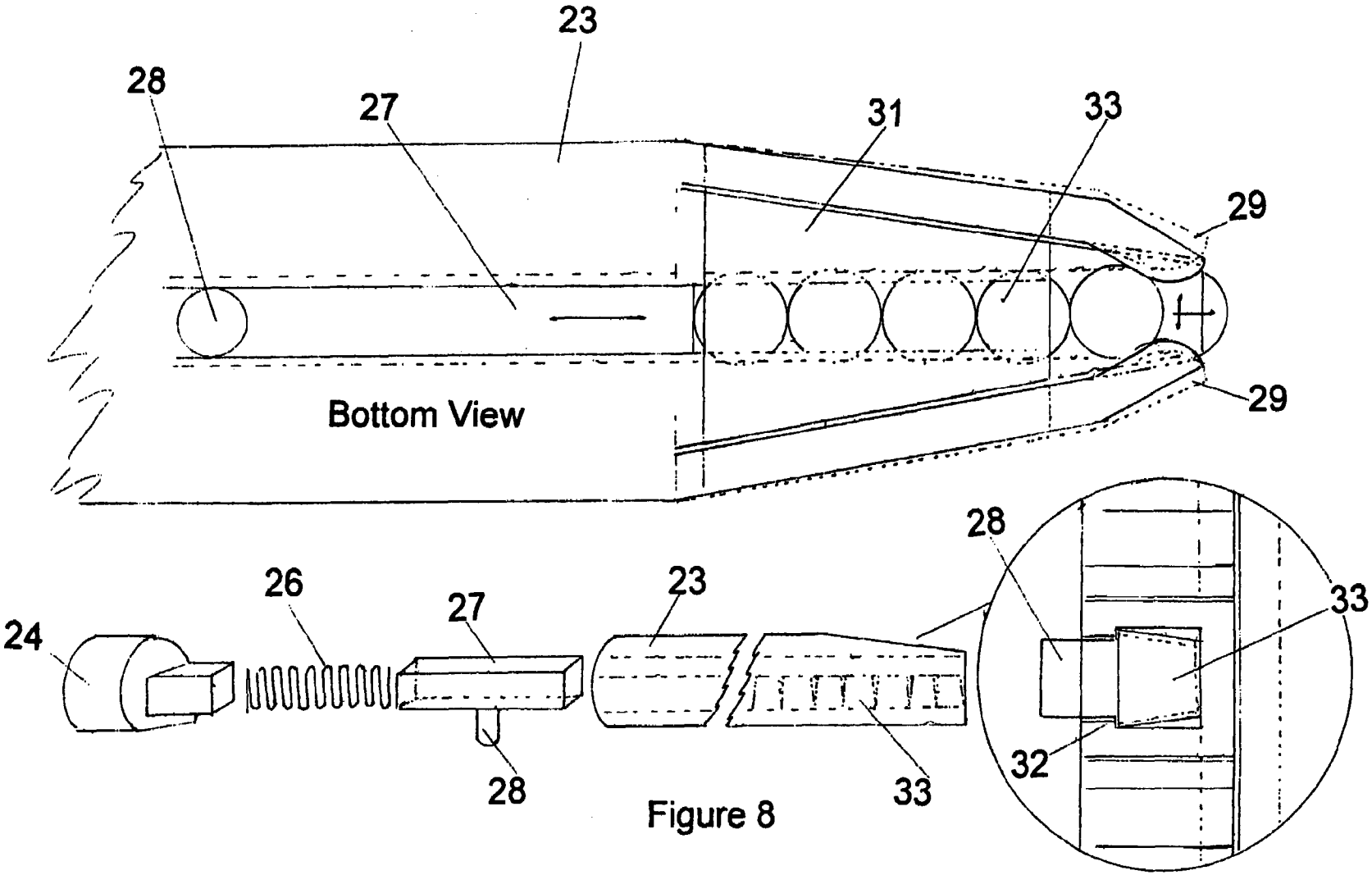
Figure 9:
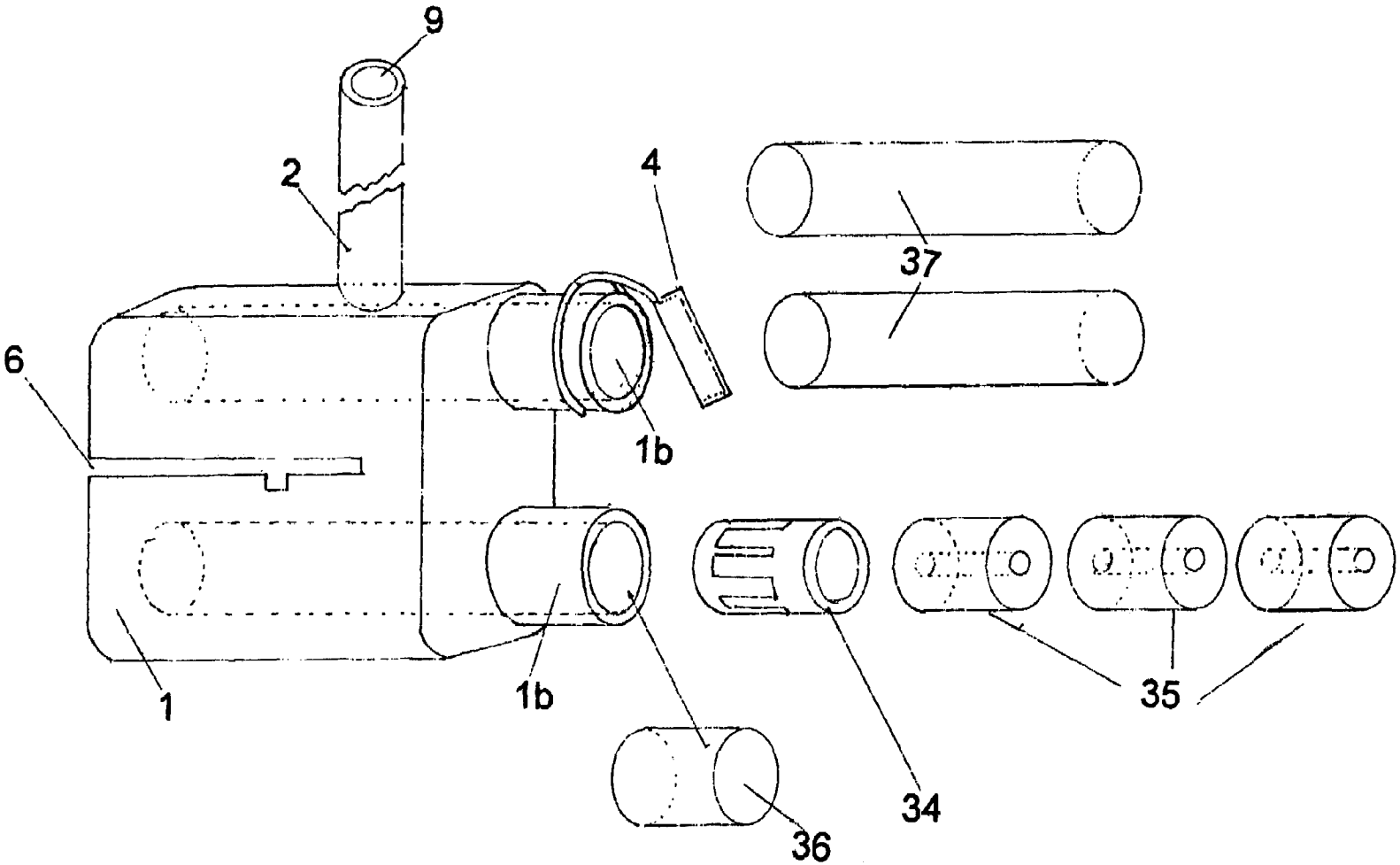

Detailed description of the invention with reference to FIGS. 1-9. Figure one is a horizontal view showing the main body (1) from both ends and both sides which is molded of a strong resin/plastic molded into the main body (1) are the bullet/projectile starter (2) which is used to seat the projectile (34) and the powder charge (35). The end of the starter (2) is concaved (9) so when the projectile is pushed down the barrel of the muzzle loader, it does not damage the end of the bullet/projectile. The main body has two loading tubes (1B) molded into it which are used to carry the complete change for loading a muzzle loading rifle. The tubes have a cap with retaining ring (4) that fits over the ends of the loading tubes that keeps the charge dry until needed. By removing a cap (4), a complete charge can be loaded in the barrel of the muzzle loader and started partway down the barrel with the starter (2) and by placing the ramrod seater (3) which is molded into the main body over the end of the rifles ramrod, the charge can be seated in the barrel to the proper depth. In order to fire the loaded charge, there must be a way to ignite the powder. This is done with either a number eleven percussion cap (33), a waterproof plastic jacket (12) for a 209 shotgun primer, or by using the 209 shotgun primer (19) by itself. The type of rifle used by the hunter will determine what type of ignition is needed. The primers fit either over the nipple that is fitted in the rear of the riffle or in a cavity at the rear of the barrel designed to accommodate an individual 209 shotgun primer (19) or the waterproof plastic jacket (12) which contains a 209 shotgun primer. When any of the three types of primers are struck with the rifles hammer, the primer explodes and sends a hot spark forward which ignites the powder charge. The 8-in-one Deluxe Field Loader which is carried around the neck by a strap that is attached to the anchor point (1*a*) has a cavity (magazine) molded into it which enables the shooter to use any one of the three types of ignitions listed. The waterproof plastic jackets (12) are loaded into the main body magazine (5) which is contained in the main body (1) and held in place by the end cap (7) by depressing the magazine cutoff (8) which moves the magazine stop pin (8*c*) out of the way and lets the shooter load three plastic jackets (12). The plastic jackets (12) are loaded by depressing the spring loaded feed unit which include a feed spring (10) and a feed rod (11) to make the loading of the plastic jackets (12) easier. The feed rod (11) can be depressed to the rear of the magazine (5) by using the guide slot (6) and locked in the notch in the guide slot (6) the feed rod (11) contains a molded in pin (11*a*) that is used for this purpose. After the three plastic jackets (12) are loaded in the magazine (5) the magazine cutoff unit (8) which includes a tension spring (8*a*), a guide slot (8*b*), and a stop pin (8*c*) is returned to the cutoff position. The feed rod (11) is released by removing the locking pin (11*a*) from the notch in the guide slot (6) and letting the feed rod (11) move forward in the guide slot (6) and come in contact with the plastic jackets (12). This puts pressure against the stop pin (8*c*). When the magazine cut off unit (8) is depressed, it allows a plastic jacket (12) to advance forward for use. To use the magazine for the individual 209 (19) shotgun primers which is made up into a complete unit which includes a main body (14), end cap (13), a feed spring (16), feed rod (17), and a loading pin (20. The shooter has to remove the feed spring (10) from the main body (1) as well as the feed rod (11). This is done by simply depressing the magazine cut off (8) and removing both the feed spring (16) and feed rod (11) from the main magazine (5). The individual 209 shotgun primer magazine is inserted into the main magazine (5) with the loading pin (20) aligned with the slot (6) in the main body (1). The stop pin (8*c*) is aligned with the alignment hole (18) in the side of the body. This allows the stop pin (8*c*) to pass through the hole (18) when the magazine cutoff (8) is released. This allows the stop pin (8*c*) to move to the center of the magazine and keep the 209 (19) primers in place. The stop pin (8*c*) also keeps the magazine from rotating in the main magazine (5). To load the 209 (19) primers, the feed rod (19) is depressed against the feed spring (16) until the loading pin (28) can be locked in the guide slot (6) in the main body. The magazine cutoff (8) is depressed allowing three 209 primers (19) to be loaded in the magazine (14) in the proper direction for used (forward). When the magazine cutoff (8) is depressed, a single 209 (19) shotgun primer is dispensed for use. When the magazine cutoff (8) is returned to the stopped position, the rest of the remaining 209 primers (19) are retained in the magazine body (14). Each time the magazine cutoff (8) is depressed it allows another 209 (19) shotgun primer to move forward for use. The third type of ignition contained in the 8-in-one Deluxe Field Loader is used for dispensing number eleven percussion caps. This magazine (23) is constructed of a translucent material and fits in the magazine (5) in the main body. The magazine (23) slides in the empty (5) magazine after depressing magazine cutoff unit (8) and is held in place by friction when the magazine cutoff (8) is released and the stop pin (8*c*) makes contact with the side of the magazine (23). The number eleven magazine (23) is designed to carry and dispense six number eleven percussion caps (33). The caps are fed forward into the flexible sides (29) for loading by a feed spring (26) and a feed rod (27). Only one percussion cap (33) is exposed at a time. When loading this percussion cap (33) onto the rifle's nipple, the cap is pressed on the nipple and the magazine (23) is pulled toward the shooter, the flexible sides (29) spread apart and released the cap (33) and the cap (33) stays on the nipple. The other caps (33) then move forward in the guide (30) allowing another cap to take the place of the one just loaded.

Unlike the previous loading procedures the number eleven percussion cap magazine is extended out for enough from the main body magazine (5) by a push pin (25) to reach a nipple that might not have much clearance around it, such as a bolt action style rifle. The magazine (23) is also tapered at the end for the same reason. The magazine (23) has a cover (31) that keeps the caps (33) securely in the guide (30) at the loading end as well as a lip (32) which extends far enough into the guide (30) to keep the caps (33) and the feed spring (26) feed rod (27) in the guide (30) an end cap (24) keeps all the components in the magazine (23). The loading of the number eleven percussion is similar to the other two magazines, but not quite the same. The number eleven percussion caps are very small and hard to handle which make them hard to load in the magazine (23). The magazine has a loading pin (28) which is used to push the feed rod (27) toward the rear of the magazine (23). This lets the shooter drop the number eleven percussion caps (33) in between the expandable sides (29). By raising the front of the magazine (23), the caps will slide down the guide (3) and under the cover (31). This procedure is repeated until six caps (33) are in place. When the feed rod (27) is allowed to make contact with the caps (33), the front cap (33) moves into the flexible sides (29) and is ready to be used. Incorporated into the 8-in-one Deluxe Field loader is a procedure that lets the device be used for more than one caliber of bullet/projectile and powder charge. The loading tubes (1*b*) are converted to a different caliber by inserting a thin plastic sleeve (37) into the tubes. This reduces the inside diameter of the loading tubes (1*b*) and lets a smaller bullet/projectile and powder charge be used. If a lighter powder charge to be used the shooter can replace one of the pellets (35) with a soft filler (36) that is the same size as the pellets (35). This filler is put in the loading tubes before inserting the bullet/projectile (34) and pellets (35) and snapping the end caps (4) over the end of the loading tubes (1*b*).

FIGURES

FIG. 1:

shows the side and ends of the main body picturing the bullet/projectile starter. The ramrod seater cavity is put over the end of the rifle's ramrod making it easier to seat the bullet and powder charge in the barrel. Included are the loading tube caps in the installed position and the neck strap anchor point. The main magazine is shown empty from the loading end. The end cap, which snaps into aligning holes in the main body, covers the parts that make up the magazine cut off unit shown in more detail in FIGS. 3, 4, and 5. This figure shows the guide slot which is molded in the main body.

FIG. 2:

shows the unit in isometric form and all parts that are contained in the main body for feeding the plastic water-proof jackets for the 209 shotgun primers (the feed spring, the feed rod, and the plastic water-proof plastic jackets which hold the 209 shotgun primers). A side view shows the body of the magazine which is used for housing and dispensing individual 209 shotgun primers. A side elevation view shows the magazine body that dispenses the number eleven percussion caps. Many of the same parts shown in this figure are shown in the other figures, too.

FIG. 3:

shows the loading tubes loaded with three powder pellets and a projectile/bullet in the order in which they are placed and carried in the loading tube prior to loading the rifle. It shows the magazine cutoff in place, and the parts that make up the magazine cutoff unit including the end cap. This figure contains the magazine cut off unit and the direction it travels when loading the magazine. Many of the same parts shown in this figure are shown in the other figures, too.

FIG. 4:

shows the parts that make up the magazine cut off unit that is installed in the end of the main body of the unit including the end cap. The unit is made of a molded plastic resin material.

FIG. 5:

shows an exploded view of the end of the unit that's used in loading an inline rifle including the recessed channel which contains the magazine cut off unit parts. It shows the order the three waterproof plastic jackets are loaded in the magazine, the feed spring compressed (loaded position), and the spring position when the magazine is empty. The loading tube caps are shown in place and the parts needed for feeding the water-proof plastic jackets forward. Many of the same parts shown in this figure are shown in the other figures, too.

FIG. 6:

shows the top and side views of the magazine body used to house and dispense the individual 209 shotgun primers. It shows the magazine in the loaded and unloaded positions, and the hole in the main body that lets the magazine cut off stop pass through the magazine to keep the primers in place until they are fed forward. Various parts are contained in the magazine in an exploded view.

FIG. 7:

shows the magazine used for storing and dispensing number eleven percussion caps when loading an inline percussion muzzle loading rifle. The magazine is shown in a top, bottom, side and end views. The top view shows the magazine empty, while the side and bottom elevation views show the magazine with six percussion caps in place. The flexible ends from the bottom view of the magazine, the channel for housing parts used in feeding the number eleven percussion caps forward, plus the lips which extend into the channel to keep the percussion caps and the parts to feed the caps in place. It, also, contains other named parts that make up the complete magazine.

FIG. 8:

shows a close up of the underside of the percussion cap magazine showing the flexible ends that expand outward when a percussion cap is removed from the magazine. When this happens the next percussion cap in line takes the place of the one just used. This figure contains end views of the magazine and the lips that retain the percussion caps and the parts used for feeding the percussion caps including exploded views of the parts that make up the magazine.

FIG. 9:

shows the loading tubes, the caliber reducing sleeves, and the soft filler that is used with a lighter powder charge (when only two pellets are used) and the order in which the soft filler bullet/projectile and the powder pellets are placed in the loading tube prior to snapping the loading tube caps on the end of the tube. The caps protect the load from moisture until needed.

NOMENCLATURE

1. Main Body
   1a. Neck strap anchor point
   1b. Loading Tubes (main)
   1c. Channel for magazine cut off
   1d. End cap alignment holes
2. Bullet/Projectile starter
3. Ramrod seater cavity
4. End caps for loading tubes with retension rings
5. Main body magazine for 209 shotgun primers used with water-proof plastic jackets
6. Guide slot with notch for locking feed rod back while loading primers
7. End cap with molded in alignment pins
   7a. Alignment pins
8. Magazine cut off which contains:
   8a. Tension spring
   8b. Guide slot
   8c. Stop pin for cutting off magazines
   8d. Guide pin molded in end cup that fits into guide slot in magazine cutoff
9. Concaved end of bullet/projectile starter
10. Feed spring for loading plastic waterproof plastic jackets that use a 209 shotgun primer
11. Feed rod for plastic water proof jackets when using 209 shotgun primers
12. Plastic waterproof jackets containing 209 shotgun primers
13. End cap for individual 209 shotgun primer magazine
14. Body of individual 209 shotgun primer magazine
15. Guide slot in magazine for individual 209 shotgun primers
16. Feed spring for individual 209 shotgun primers magazine
17. Feed rod for individual 209 shotgun primer magazine
18. Alignment hole for magazine cut off used in the individual 209 shotgun magazine. This hole lets the stop in enter the side of the magazine cutting off the individual primers until needed.
19. Individual 209 shotgun primers
20. Loading pin which is molded into the feed rod in the individual 209 shotgun primer magazine
21. Feed spring in depressed position in the individual 209 shotgun primer magazine
22. End of the individual 209 shotgun primer magazine when loaded
23. Body of magazine used for number eleven percussion caps
24. End cap for number eleven percussion cap magazine
25. Pin for pushing number eleven percussion cap magazine into loading position
26. Loading spring for number eleven percussion caps
27. Feed rod for number eleven percussion caps
28. Loading pin for number eleven percussion caps. This pin is depressed for loading the number eleven percussion caps into the magazine prior to capping the rifle.
29. Flexible ends of the number eleven percussion cap magazine
30. Number eleven percussion cap magazine. This slot houses the feed spring, loading pin, feed rod, and the percussion caps.
31. Number eleven percussion cap cover. This cover keeps the caps in place until they are fed into the flexible sides for loading.
32. Bottom of number eleven percussion cap magazine. The bottom has a lip that keeps the caps securely in the magazine channel and keeps the magazine components in place.
33. Number eleven percussion cap loaded in the magazine
34. Projectile/bullet
35. Projectile/bullet propellent (powder)
36. Soft filler used in the bottom of the loading tubes when using a light load to keep the charge from sliding back and forth which might damage the pellets or make unwanted noise.
37. Caliber reducing sleeves. The sleeves are used to let the loading tubes handle bullets and projectiles of different calibers.
38. Channel in number eleven percussion cap magazine for housing caps and the other components used in the magazine.

The invention claimed is:

1. A muzzle loading device for muzzle loading firearms comprising:

a main body:

at least one hollow cylinder disposed within the main body, the cylinder configured for containing at least one projectile and at least one propellant;

a first magazine disposed within the main body for storing primers and including a biasing member configured to outwardly urge contents disposed within the magazine; and, a cutoff assembly including:

a cutoff member disposed in a channel disposed in the main body, the cutoff member configured to prevent the outward urging of the biasing member.

2. The device of claim 1, wherein the at least one hollow cylinder is two hollow cylinders.

3. The device of claim 1, wherein the first magazine further comprises a feed rod and plastic jackets containing shotgun primers.

4. The device of claim 1, further comprising a second magazine insertable into the first magazine.

5. The device of claim 4, wherein the primers are either shotgun primers or percussion caps.

6. The device of claim 5, wherein the second magazine further comprises a biasing member, a loading pin and an end cap.

7. The device of claim 1, wherein the at least one hollow cylinder is further configured to contain soft filler or caliber reducing sleeves.

8. The device of claim 1, further comprising a projectile starter.

9. The device of claim 8, wherein the projectile starter further comprises a concaved end.

10. The device of claim 1, wherein the main body further comprises at least one end cap configured to cover the at least one hollow cylinder.

11. The device of claim 1, further comprising a protrusion including a through hole configured to receive a strap.

12. The device of claim 1, wherein the cutoff assembly further includes a tension spring.

* * * * *